US010648242B2

(12) United States Patent
Hooper

(10) Patent No.: US 10,648,242 B2
(45) Date of Patent: May 12, 2020

(54) DRILLING COMPONENT COUPLER FOR REINFORCEMENT

(71) Applicant: Halliburton Energy Services, Inc., Houston, TX (US)

(72) Inventor: Michael Edward Hooper, Porter, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/014,460

(22) Filed: Jun. 21, 2018

(65) Prior Publication Data

US 2019/0390521 A1 Dec. 26, 2019

(51) Int. Cl.
*E21B 17/046* (2006.01)
*E21B 17/042* (2006.01)

(52) U.S. Cl.
CPC ..... *E21B 17/046* (2013.01); *E21B 17/042* (2013.01)

(58) Field of Classification Search
CPC ..... E21B 17/046; E21B 17/042
See application file for complete search history.

(56) References Cited

U.S. PATENT DOCUMENTS 3,870,351 A 3/1975 Matsuki
4,462,472 A * 7/1984 Beimgraben ..... E21B 4/02 175/107
6,607,220 B2 8/2003 Sivley, IV
2015/0107904 A1 4/2015 Kerstetter
2018/0023611 A1 1/2018 Kalantari et al.

FOREIGN PATENT DOCUMENTS

EP 2210030 9/2015

OTHER PUBLICATIONS

Hollypipe, "Drilling Tubulars, Drill Pipe & Pipe Casing", available at http://www.hollypipe.com/drill-pipe.html at least as early as Apr. 11, 2018, 5 pages.
International Application No. PCT/US2019/032234, "International Search Report and Written Opinion", dated Aug. 20, 2019, 13 pages.

* cited by examiner

*Primary Examiner* — Kristyn A Hall
(74) *Attorney, Agent, or Firm* — Kilpatrick Townsend & Stockton LLP

(57) ABSTRACT

A drill tool that is usable in drilling a wellbore can include a pin component and a box component. The pin component has a threaded portion and an extended portion extending axially from an end of the threaded portion. The box component is part of a stator of a downhole drilling motor. The box component is threadedly coupled to the pin component such that the extended portion of the pin component is positioned in an inner area defined by the box component to absorb stress from the threaded portion during a bend for a wellbore drilling operation.

14 Claims, 6 Drawing Sheets

DRILLING COMPONENT COUPLER FOR REINFORCEMENT

TECHNICAL FIELD

The present disclosure relates to devices and methods for use in drilling for hydrocarbons such as oil and gas. More specifically, this disclosure relates to coupling components of a drilling assembly.

BACKGROUND

A wellbore can be drilled into a subterranean formation to extract formation fluids such as oil or gas. The wellbore can be drilled using a drill string that can include a bottomhole assembly (BHA), a drill bit, and other components. The wellbore may be a vertical wellbore or a deviated wellbore in which the wellbore is intentionally drilled in a direction other than solely in a vertical direction.

A deviated wellbore can be accomplished by using whipstocks, BHA configurations, instruments to measure the path of the wellbore in three-dimensional space, data links to communicate measurements taken downhole to the surface, mud motors, and drill bits. Drilling parameters such as weight on bit and rotary speed can be used to deflect the bit away from the axis of the existing wellbore.

A bend near the bit in a downhole steerable mud motor can be used in directional drilling. The bend can point the bit in a direction that is different from the axis of the wellbore when the drill string is not rotating. By pumping mud through the mud motor, the bit turns while the drill string does not rotate, allowing the bit to drill in the direction it points. When a particular wellbore direction is achieved, that direction may be maintained by rotating the drill string, including the bent section. Directional drilling can allow drillers to place the wellbore in contact with selected reservoir rock.

The mud motor can include a stator and rotor configuration—the stator being the stationary component and rotor being the component that rotates. The stator can be coupled to other components of the drill string. As the drill string bends, the point at which the stator is coupled to the other components can experience stress and be susceptible to breaking, which can delay drilling and be costly.

DETAILED DESCRIPTION

Certain aspects and examples of the disclosure relate to a coupling for stator of a motor to another component of a drill string that can provide reinforcement and withstand higher level of stresses downhole without breaking. The coupling can include a threaded portion of two components—a pin threaded portion for one component of the drill string and a box threaded portion for the stator. At least the pin component can include an extended portion that extends from the threaded portion and into an inner area defined by the box threaded portion of the stator. (The extended portion may be referred to as a "nose.") The cross-sectional thickness of the extended portion and the box component can be increased as compared to a coupling without the extended portion. The extended portion can prevent bend fatigue of the components and otherwise reinforce the components. For example, the extended portion can prevent a reduction in stability during bend operations of the drill string. As a result, failures of drilling motors can be reduced and torque-carrying capacity can be increased.

In one example, the pin component is part of a top sub-assembly for the drill string that can couple to part of the stator of a mud motor. Although threaded couplings are described, an extended portion can also be used with other types of couplings, such as interference couplings. For example, the extended portion can have an interference fit with the stator, or by a clearance fit with additional surface area when used with thread-locking components.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
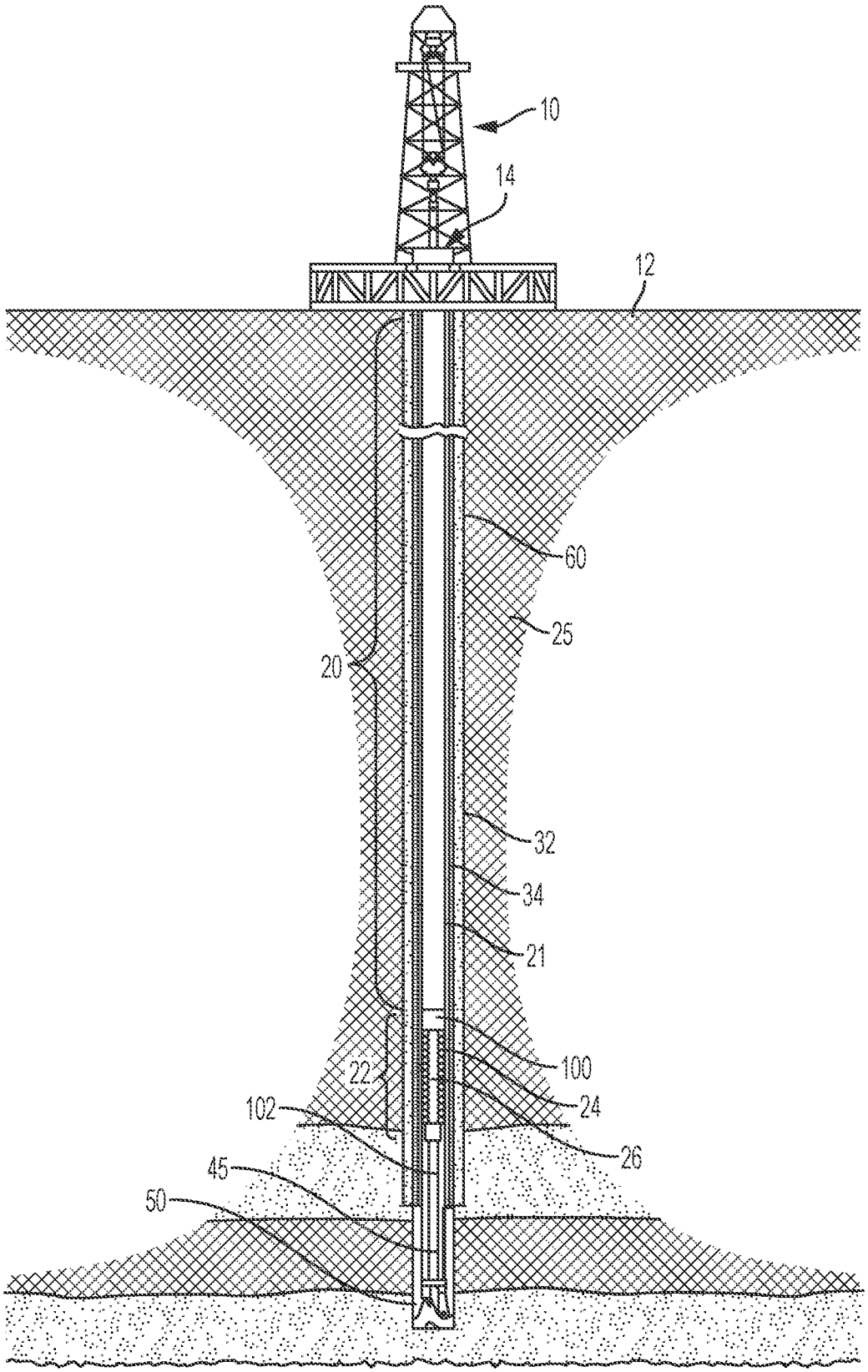
FIG. 1 is a schematic illustration of a drilling rig and downhole equipment including a downhole drilling motor disposed in a wellbore according to one aspect of the present disclosure.

FIG. 1 is a schematic illustration of a drilling rig 10 and downhole equipment including a downhole drilling motor disposed in a wellbore according to one example. The drilling rig 10 is located at or above the surface 12 and can rotate a drill string 20 disposed in a wellbore 60 below the surface 12. The drill string 20 can include a drill pipe 21 connected to a upper saver sub of a downhole positive displacement motor, which includes a stator 24 and a rotor 26 that generate and transfer torque down the borehole to a drill bit 50 or other downhole equipment attached to a longitudinal output shaft 45 of the downhole positive displacement motor. An example of the downhole positive displacement motor is a Moineau-type motor. The surface equipment 14 on the drilling rig 10 can rotate the drill string 20 and the drill bit 50 as it bores into the Earth's crust 25 to form a wellbore 60. The wellbore 60 is reinforced by a casing 34 and a cement sheath 32 in the annulus between the casing 34 and the borehole wall. The rotor 26 of the power section can be rotated relative to the stator 24 due to a pumped pressurized drilling fluid flowing through a power section 22 (e.g., positive displacement mud motor). Rotating the rotor 26 can cause an output shaft 102 to rotate. The output shaft 102 can rotate to energize components of the tool string 40 disposed below the power section. The surface equipment 14 may be stationary.

Energy generated by a rotating shaft in a downhole power section can be used to drive a variety of downhole tool functions. Components of the tool string may be energized by the mechanical energy generated by the power section 22, For example, a drill bit or an electrical power generator can be driven by the mechanical energy. Dynamic loading at the outer mating surfaces of the rotor 26 and the stator 24 during operation can result in direct wear at the surface of the components and can produce stress within the body of the components.

Dynamic mechanical loading of the stator 24 by the rotor 26 can also be affected by the mechanical loading caused by bit or formation interactions. This variable mechanical loading can cause fluctuations in the mechanical loading of the stator 24 by the rotor 26, which can result in operating efficiency fluctuations. And, stresses may be experienced at the coupling of the stator 24 to other components of the drill string 20, which can result in the drill string 20 breaking at that point. By inserting a top sub-assembly 100 at an end of the rotor 26 that includes a reinforcement coupling with an extended portion to couple to the stator 24, the coupling to the stator 24 can withstand higher levels of bending without failing.

Figure 2:
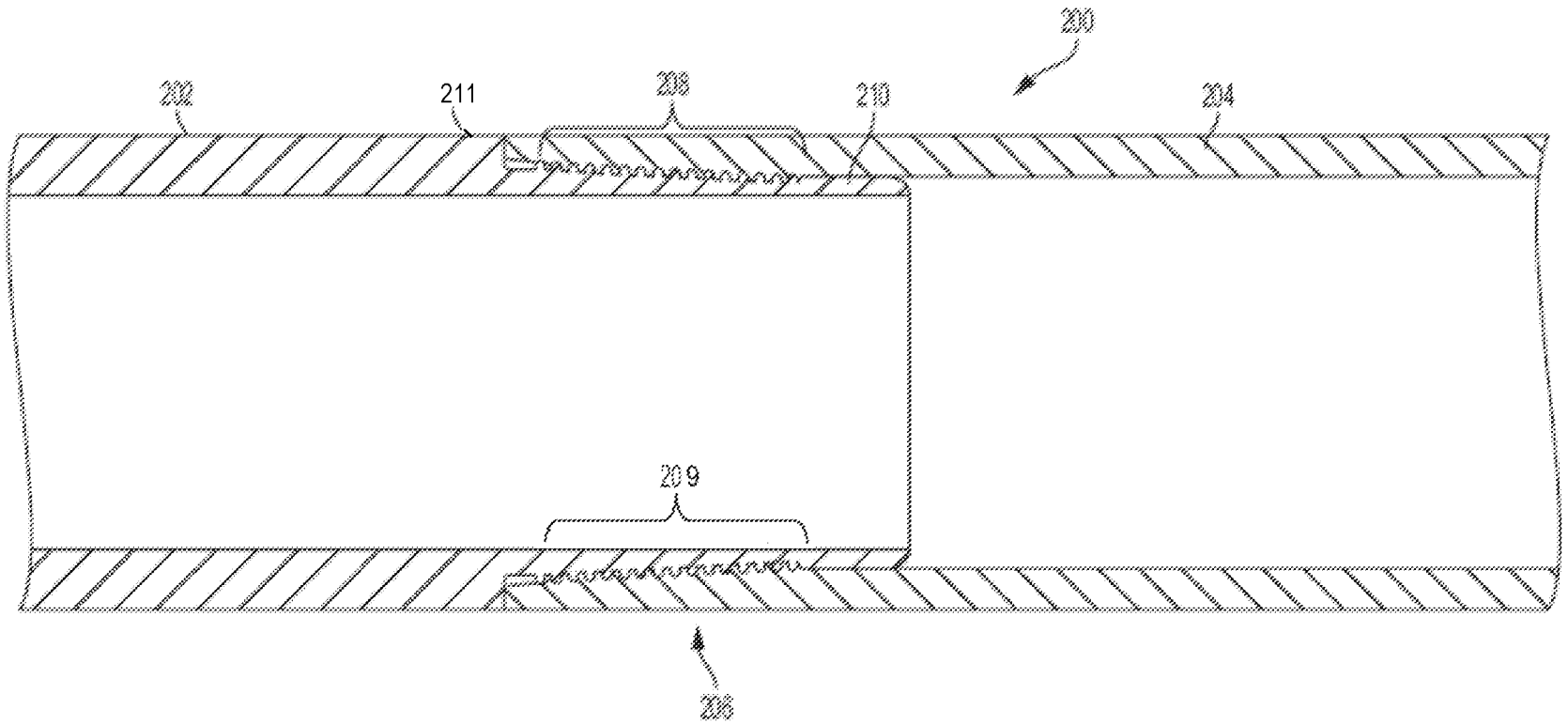
FIG. 2 depicts a cross-sectional side view of an example of a coupling for a drill string according to one aspect of the present disclosure.

FIG. 2 depicts a cross-sectional side view of an example of a coupling 206 for part 200 of a drill string according to one aspect of the present disclosure. The coupling 206 is between two components of the drill string: a pin component 202 and a box component 204 that is part of a stator. In some examples, the pin component 202 may be a top sub-assembly of the drill string or a drilling motor.

The pin component 202 includes a threaded portion 208 that is coupled to a corresponding threaded portion 209 of the box component 204. Extending axially from an end of the threaded portion 208 is an extended portion 210 of the pin component 202. The extended portion 210 extends from an end of the threaded portion 208 that is opposite to another end by which a body 211 of the pin component 202 extends. The body 211 has a larger outer diameter than the extended portion 210.

The extended portion 210 is positioned in an inner area defined by the box component 204. The extended portion 210 may couple to the box component 204 by an interference fit. The extended portion 210 can increase the cross-section modulus of the coupling 206. For example, the cross-sectional thickness of the part 200 of the drill string with the extended portion 210 and the box component 204 can be greater than if the extended portion 210 was absent from the pin component 202. The additional cross-sectional thickness can help prevent the drill string from breaking at the coupling 206 in response to stress on the drill string. For example, the extended portion 210 can absorb stress from the threaded portion 208.

The extended portion 210 may be any suitable length and made from any suitable materials. Examples of a suitable length include 1.5 inches and 2 inches. Examples of suitable materials include steel. The extended portion 210 may be made as a continuous part of the pin component 202 or affixed to the end of the threaded portion 208 via a suitable material or mechanical coupling. For example, the extended portion 210 can be glued using epoxy to the end of the threaded portion 208 of the pin component.

Figure 3:
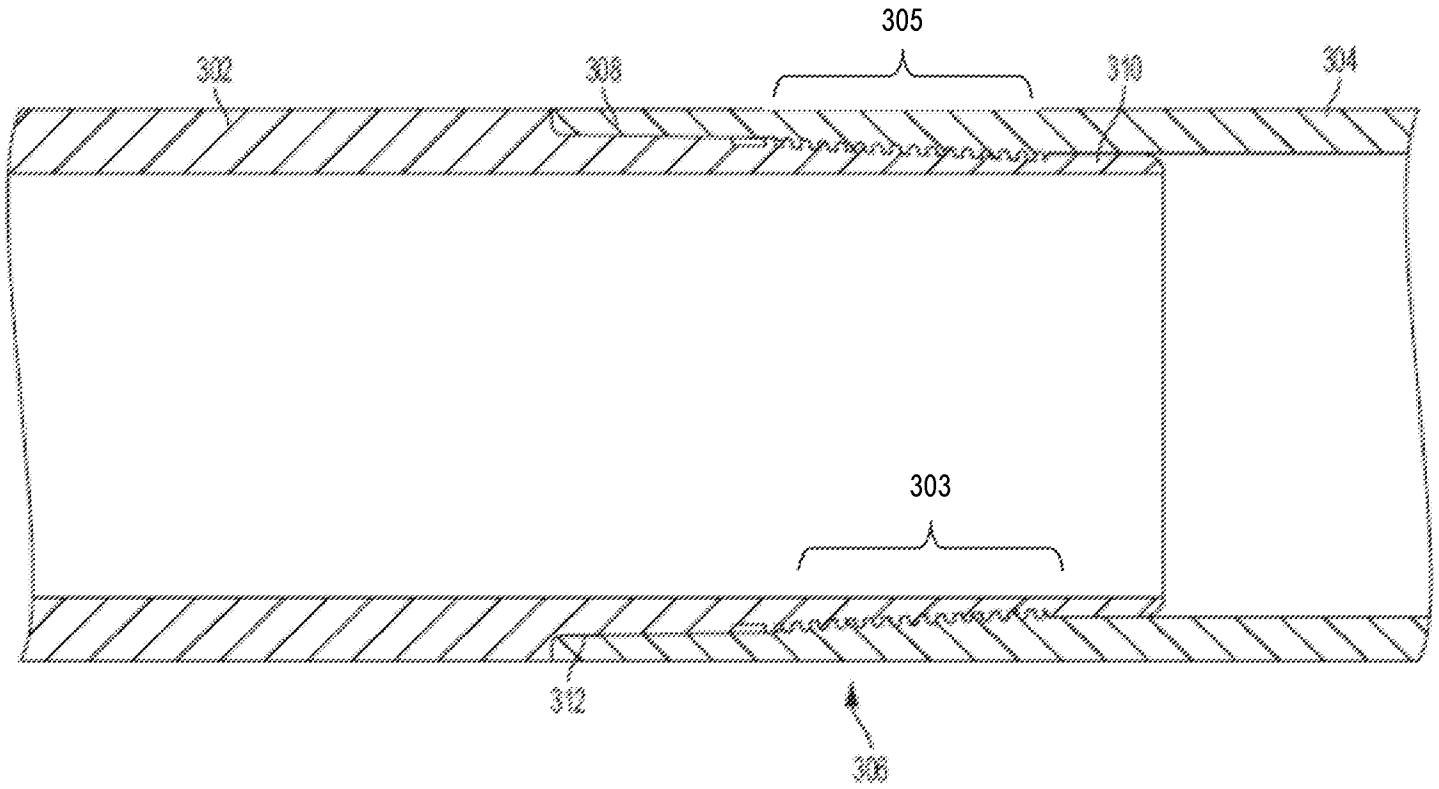
FIG. 3 depicts a cross-sectional side view of another example of a coupling for a drill string according to one aspect of the present disclosure.

FIG. 3 depicts a cross-sectional side view of another example of a coupling 306 for a drill string according to one aspect of the present disclosure. In this example, a pin component 302 with an extended portion 310 that extends from threads 303 of the pin component 302 is coupled to a box component 304 that also has an extended portion 308 that extends from the threads 305 of the box component 304. The extended portion 308 can extend externally to part of the pin component 302. For example, the pin component 302 can include a recess 312 for receiving the extended portion 308 of the box component 304. The extended portion 308 can provide more surface area on which to apply epoxy to provide the coupling 306 with higher torsional strength.

Figure 4:
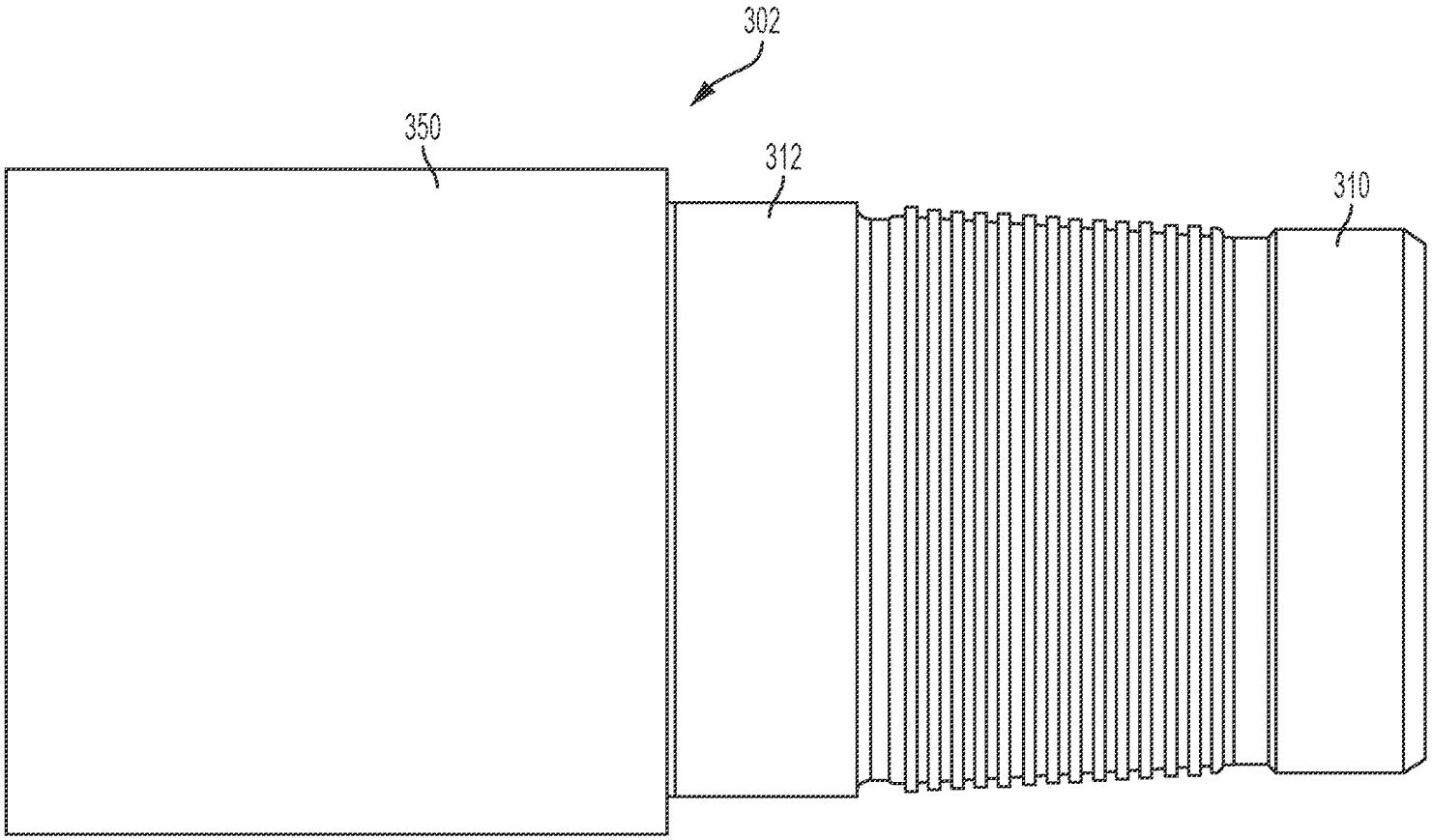
FIG. 4 depicts a side view of the pin component of FIG. 3 according to one aspect of the present disclosure.

FIG. 4 depicts a side view of the pin component 302 according to one aspect of the present disclosure. The recess 312 has a smaller outer diameter than a body 350 of the pin component 302, but has a larger outer diameter than the extended portion 310.

Figure 5:
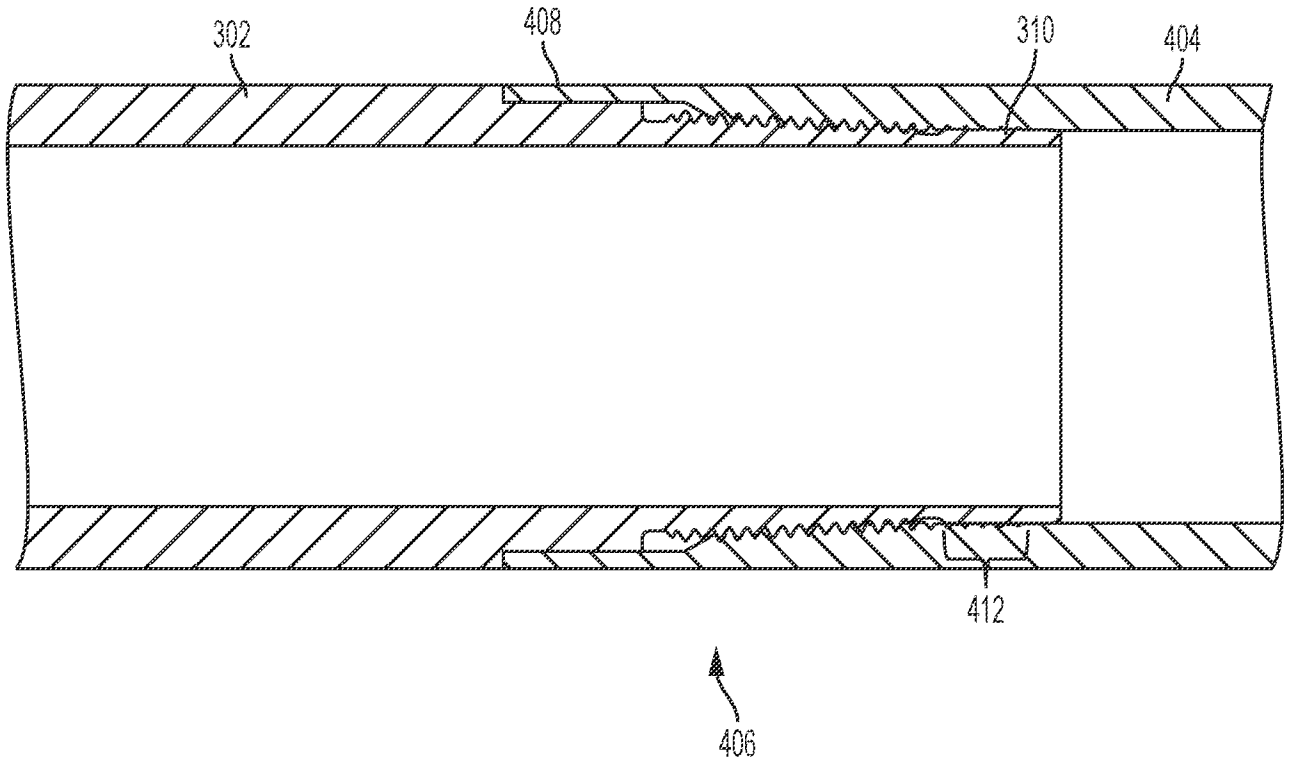
FIG. 5 depicts a cross-sectional side view of a further example of a coupling for a drill string according to one aspect of the present disclosure.

FIG. 5 depicts a cross-sectional side view of a further example of a coupling 406 for a drill string according to one aspect of the present disclosure. In this example, the pin component 302 with the extended portion 310 from the threads is to a box component 404 that has an extended portion 408 and openings 412 in a sidewall.

Figure 6:
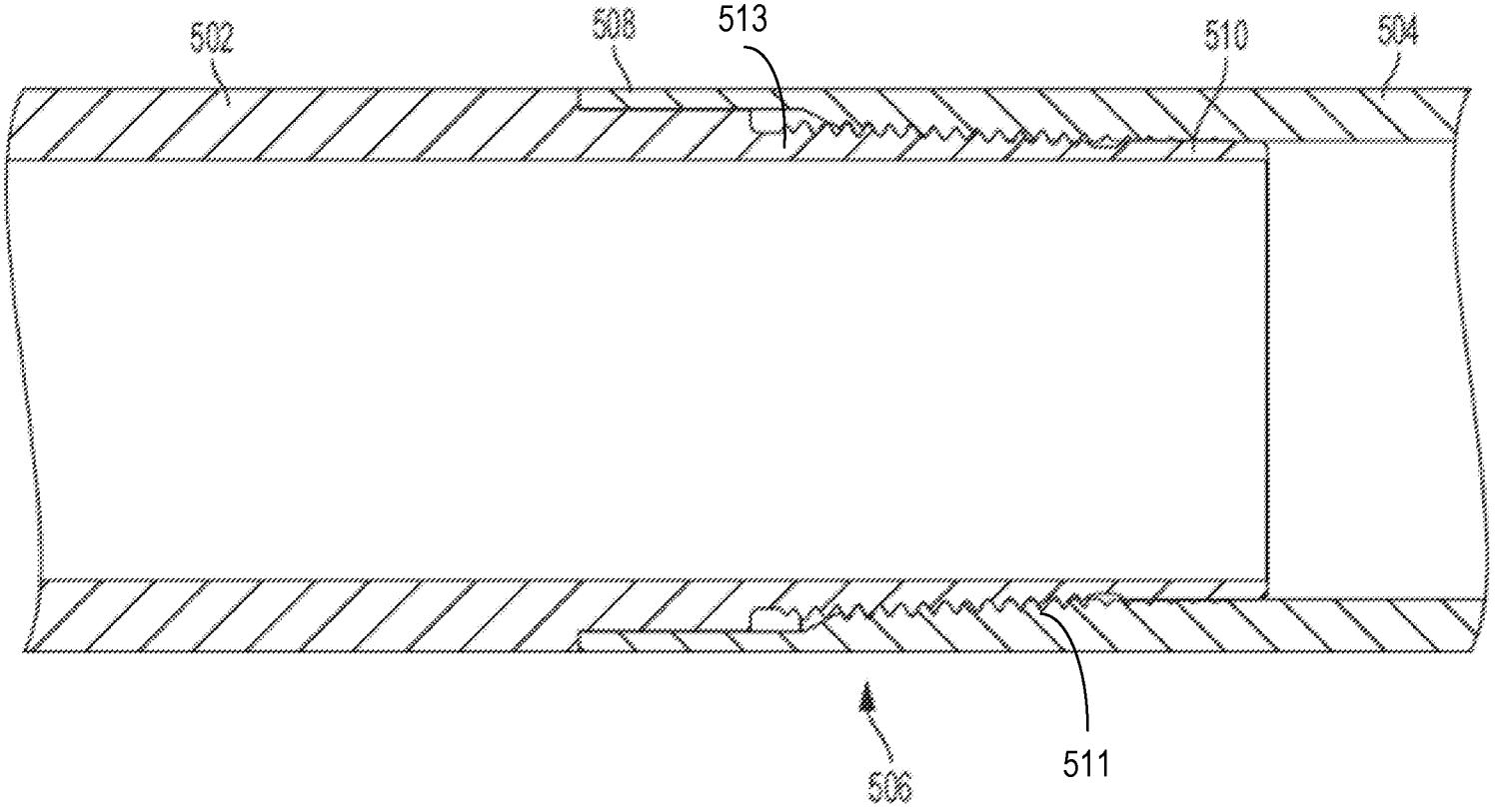
FIG. 6 depicts a cross-sectional side view of an additional example of a coupling for a drill string according to one aspect of the present disclosure.

FIG. 6 depicts a cross-sectional side view of an additional example of a coupling 506 for a drill string according to one aspect of the present disclosure. In this example, a pin component 502, with an extended portion 510, is coupled to a box component 504 using a buttress thread 511, which can be referred to as a breech-lock thread. The buttress thread 511 can spread forces from stress and reduce the forces from concentrating on a particular part of the coupling 506 to further reduce the chance of a break. The buttress thread 511 can also provide a larger radius at the base 513 of the buttress thread 511.

Other examples of types of threads that may be used include Acme, Stub Acme, Knuckle, Whitworth, 60° Stub, Din, V.038, V.040, V.050, V.065, V.076, 90-V.050, and 90-V.084.

In some aspects, systems, devices, and methods for coupling components of a drill tool are provided according to one or more of the following examples:

Example 1 is a pin component for a drill string, the pin component comprising: a threaded portion; and an extended portion extending axially from an end of the threaded portion and being positionable in an inner area defined by a box component that is part of a stator of a drilling motor for coupling to the box component, the extended portion is positionable to absorb stress from the threaded portion during a bend for a wellbore drilling operation.

Example 2 is the pin component of example 1, wherein the pin component is a top sub-assembly of the drill string.

Example 3 is the pin component of example 2, wherein the top sub-assembly comprises a first end and a second end, the top sub-assembly being couplable to a drill pipe at the first end and to the stator at the second end, the drilling motor including a rotor to generate and transfer torque to a drill bit. Example 4 is the pin component of example 1, wherein the pin component comprises a body extending from the threaded portion on an opposite end than the extended portion, the body having a larger outer diameter than the extended portion.

Example 5 is the pin component of example 1, wherein the pin component includes a recess to receive a box extended portion externally to the pin component.

Example 6 is the pin component of example 5, wherein the recess has a larger outer diameter than the extended portion.

Example 7 is the pin component of example 1, wherein the extended portion is positionable radially adjacent to openings in a sidewall of the box component.

Example 8 is the pin component of example 10, wherein the threaded portion comprises buttress threads.

Example 9 is a drill tool usable in drilling a wellbore, the drill tool comprising: a pin component having a threaded portion and an extended portion extending axially from an end of the threaded portion; and a box component that is part of a stator of a downhole drilling motor, the box component being threadedly coupled to the pin component such that the extended portion of the pin component is positioned in an inner area defined by the box component to absorb stress from the threaded portion during a bend for a wellbore drilling operation.

Example 10 is the drill tool of example 9, wherein the pin component is a top sub-assembly.

Example 11 is the drill tool of example 10, wherein the top sub-assembly comprises a first end and a second end, the top sub-assembly being coupled to a drill pipe at the first end and to the stator at the second end, drilling motor including a rotor to generate and transfer torque to a drill bit.

Example 12 is the drill tool of example 9, wherein the pin component comprises a body extending from the threaded portion on an opposite end than the extended portion, the body having a larger outer diameter than the extended portion.

Example 13 is the drill tool of example 9, wherein the box component includes a box extended portion that extends axially from threads of the box component, wherein the pin component includes a recess to receive the box extended portion externally to the pin component.

Example 14 is the drill tool of example 13, wherein the recess has a larger outer diameter than the extended portion.

Example 15 is the drill tool of example 9, wherein the pin component and the box component are coupled by buttress threads.

Example 16 is a wellbore drilling assembly comprising: a drill pipe controllable from a surface of a wellbore; a top sub-assembly comprising a first end and a second end, the top sub-assembly being coupled to the drill pipe at the first end and having a pin component at the second end, the pin component including a threaded portion and an extended portion extending axially from the threaded portion; a drilling motor coupled to the second end of the top sub-assembly, the drilling motor comprising: a rotor to generate and transfer torque to a drill bit; and a stator couplable to the pin component of the top sub-assembly as a box component in a pin-and-box coupling that includes the pin component positioned in an inner area defined by part of the stator.

Example 17 is the wellbore drilling assembly of example 16, wherein the extended portion is positionable to absorb stress from the threaded portion as part of the wellbore drilling assembly bends during a wellbore drilling operation.

Example 18 is the wellbore drilling assembly of example 16, wherein a stator extended portion extends axially from threads of the stator, wherein the pin component includes a recess to receive the stator extended portion externally to the pin component.

Example 19 is the wellbore drilling assembly of example 18, wherein the recess has a larger outer diameter than the extended portion.

Example 20 is the wellbore drilling assembly of example 16, wherein the pin component and the stator are coupled by buttress threads.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A pin component for a drill string, the pin component comprising:

a threaded portion;

an extended portion extending axially from an end of the threaded portion and being positionable in an inner area defined by a box component that is part of a stator of a drilling motor for coupling to the box component, the extended portion is positionable to absorb stress from the threaded portion during a bend for a wellbore drilling operation;

a recess extending axially from the threaded portion on an opposite end than the extended portion to receive a box-extended portion externally to the pin component, wherein a first outer surface of the recess comprises a first diameter that is greater than a second diameter of a second outer surface of the extended portion, and wherein the first outer surface of the recess is parallel with the second outer surface of the extended portion; and a body extending axially from the recess, wherein a third outer surface of the body comprises a third diameter that is greater than the first diameter of the first outer surface of the recess.

2. The pin component of claim 1, wherein the pin component is a top sub-assembly of the drill string.

3. The pin component of claim 2, wherein the top sub-assembly comprises a first end and a second end, the top sub-assembly being couplable to a drill pipe at the first end and to the stator at the second end, the drilling motor including a rotor to generate and transfer torque to a drill bit.

4. The pin component of claim 1, wherein the extended portion is positionable radially adjacent to openings in a sidewall of the box component.

5. The pin component of claim 1, wherein the threaded portion comprises buttress threads.

6. A drill tool usable in drilling a wellbore, the drill tool comprising:

a pin component having:

a threaded portion;

an extended portion extending axially from an end of the threaded portion;

a recess extending axially from the threaded portion on an opposite end than the extended portion, wherein a first outer surface of the recess comprises a first diameter that is greater than a second diameter of a second outer surface of the extended portion, and wherein the first outer surface of the recess is parallel with the second outer surface of the extended portion; and a body extending axially from the recess, wherein a third outer surface of the body comprises a third diameter that is greater than the first diameter of the first outer surface of the recess; and a box component that is part of a stator of a downhole drilling motor, the box component being threadedly coupled to the pin component such that the extended portion of the pin component is positioned in an inner area defined by the box component to absorb stress from the threaded portion during a bend for a wellbore drilling operation.

7. The drill tool of claim 6, wherein the pin component is a top sub-assembly.

8. The drill tool of claim 7, wherein the top sub-assembly comprises a first end and a second end, the top sub-assembly being coupled to a drill pipe at the first end and to the stator of a drilling motor at the second end, the drilling motor including a rotor to generate and transfer torque to a drill bit.

9. The drill tool of claim 6, wherein the box component includes a box-extended portion that extends axially from threads of the box component, wherein the recess of the pin component is positionable to receive the box-extended portion externally to the pin component.

10. The drill tool of claim 6, wherein the pin component and the box component are coupled by buttress threads.

11. A wellbore drilling assembly comprising:

a drill pipe controllable from a surface of a wellbore;

a top sub-assembly comprising a first end and a second end, the top sub-assembly being coupled to the drill pipe at the first end and having a pin component at the second end, the pin component including:

a threaded portion;

an extended portion extending axially from the threaded portion;

a recess extending axially from the threaded portion on an opposite end than the extended portion, wherein a first outer surface of the recess comprises a first diameter that is greater than a second diameter of a second outer surface of the extended portion, and wherein the first outer surface of the recess is parallel with the second outer surface of the extended portion; and a body extending axially from the recess, wherein a third outer surface of the body comprises a third diameter that is greater than the first diameter of the first outer surface of the recess a drilling motor coupled to the second end of the top sub-assembly, the drilling motor comprising:

a rotor to generate and transfer torque to a drill bit; and a stator couplable to the pin component of the top sub-assembly as a box component in a pin-and-box coupling that includes the pin component positioned in an inner area defined by part of the stator.

12. The wellbore drilling assembly of claim 11, wherein the extended portion is positionable to absorb stress from the threaded portion as part of the wellbore drilling assembly bends during a wellbore drilling operation.

13. The wellbore drilling assembly of claim 11, wherein a stator extended portion extends axially from threads of the stator, wherein the recess of the pin component is positionable to receive the stator extended portion externally to the pin component.

14. The wellbore drilling assembly of claim 11, wherein the pin component and the stator are coupled by buttress threads.

* * * * *